United States Patent [19]

Hartwein et al.

[11] Patent Number: 5,033,617

[45] Date of Patent: Jul. 23, 1991

[54] CASE FOR HOLDING TOOLS FOR ORAL AND DENTAL CARE

[75] Inventors: Peter Hartwein, Königstein; Gottfried Voigt, Frankfurt am Main, both of Fed. Rep. of Germany

[73] Assignee: Braun Aktiengesellschaft, Kronberg, Fed. Rep. of Germany

[21] Appl. No.: 490,669

[22] PCT Filed: Sep. 6, 1988

[86] PCT No.: PCT/DE88/00547

§ 371 Date: Mar. 6, 1990

§ 102(e) Date: Mar. 6, 1990

[87] PCT Pub. No.: WO89/02234

PCT Pub. Date: Mar. 23, 1989

[30] Foreign Application Priority Data

Sep. 19, 1987 [DE] Fed. Rep. of Germany ..... 3731587

[51] Int. Cl.[5] ..... B65D 83/00

[52] U.S. Cl. ..... 206/362.1; 206/209.1; 206/369

[58] Field of Search ..... 206/362, 362.1, 362.3, 206/209, 209.1, 63.5, 368, 369, 349

[56] References Cited

U.S. PATENT DOCUMENTS

| | | | |
|---|---|---|---|
| 1,361,842 | 12/1920 | Evslin | 206/209.1 |
| 1,566,860 | 12/1925 | Hainzigianis | 206/362.1 |
| 1,584,261 | 5/1926 | Vuolo | 206/362.1 |
| 1,803,194 | 4/1931 | Kennedy | 206/209.1 |
| 2,209,091 | 7/1940 | Piker . | |
| 2,280,431 | 4/1942 | Hart | 206/209.1 |
| 3,189,391 | 6/1965 | Magrauth . | |
| 3,727,748 | 4/1973 | Brown | 206/362.1 |
| 3,881,868 | 5/1975 | Duke . | |

FOREIGN PATENT DOCUMENTS

| | | |
|---|---|---|
| 973518 | 7/1949 | Fed. Rep. of Germany . |
| 1744090 | 2/1957 | Fed. Rep. of Germany . |
| 2653494 | 2/1977 | Fed. Rep. of Germany . |
| 7510834 | 4/1977 | Fed. Rep. of Germany . |
| 3002419 | 8/1980 | Fed. Rep. of Germany . |
| 3246048 | 6/1984 | Fed. Rep. of Germany . |
| 3312451 | 10/1984 | Fed. Rep. of Germany . |
| 8402015 | 7/1985 | Fed. Rep. of Germany . |
| 1506496 | 11/1967 | France . |
| 551179 | 5/1974 | Switzerland . |
| 1275503 | 5/1972 | United Kingdom . |

*Primary Examiner*—William I. Price
*Attorney, Agent, or Firm*—Fish & Richardson

[57] ABSTRACT

The invention is directed to a case (10) serving to receive tools for oral and dental care and including an interior space (14). A removable insert (16) having a number of compartments (18) is adapted to be fitted into the interior space (14). An element (20) is pivotal about a pivot axis (32) from a dust-guard position (22) to an open position (24). The element (20) is configured as a substantially plane case lid covering the interior space (14) in the dust-guard position (22). The element (20) and the insert (16) are in relative connection by means of a lever mechanism (30), with the lever mechanism (30) convertinig a pivoting motion of the element (20) into a lifting motion of the insert (16).

16 Claims, 4 Drawing Sheets

CASE FOR HOLDING TOOLS FOR ORAL AND DENTAL CARE

This invention relates to a case. From DE-A1 3,246,048 a case for holding tools for oral and dental care is already known which includes an inner chamber receiving a removable insert. In the insert, a number of compartments are provided for accommodating the tools. An element pivotal about a pivot axis from a dust-guard position to an open position serves to protect the tools from contamination. This known case, however, has several disadvantages.

Because the pivotal element is configured as a hood cover having its front open, the tools received in the insert are only insufficiently protected from contamination. In particular in applications where the case is mounted on the bathroom wall, the tools are very awkward to remove, especially for small persons, such as children. In addition, the color markings conventionally provided on the tools to distinguish between the individual tools which, while looking essentially alike, are intended for use by different persons, are difficult to recognize, so that as a rule the wrong tool is first removed from the insert. Further, the case and the insert are not particularly well suited for cleaning by hand. There is no drain for the water dripping, for example, from a brush head for an electric toothbrush or a jet head of an electric dental water-jet device after use. Nor does any circulation of air occur through the inner chamber of the case and the insert to speed up the drying process of the toothbrushes. Finally, the known case lacks an enclosed and pleasing as well as functional shape appealing to the aesthetic sense of the user.

From DE-A1 3,312,451 a further case is known in which the tools for oral and dental care are received in suitable openings provided in a bottom plate of the case. Not only are the tools unprotected, thus being exposed to external contamination, but they also soil the surface of the case by water drippings mixed, for example, with oral care products or toothpaste.

U.S. Pat. No. 2,209,091 discloses a box used for carrying tools, makeup or the like, which includes a hingedly mounted lid as well as an inner tray. The inner tray is connected to the lid and to the box by means of two hinge joints each and executes on opening of the lid substantially a pivot motion with a minor lifting motion superposed. It is thereby ensured that with the lid open the user of the box is also able to remove from the box those parts that lie underneath the inner tray, these parts being substantially covered by the inner tray when the lid is closed. The inner tray is fixedly connected to the box and to the lid by means of hinge joints and is not readily removable. A guide for the inner tray in the box is not provided, making no sense for the applications described therein, because the space in the box underneath the inner tray is to be accessible to the user.

Finally, from DE-A1 2,653,494 an oral hygiene device is known in which the jet heads are arranged upright and essentially unprotected in suitable recesses provided in a side wall area of the case. On account of its special construction, this case is very awkward to clean, and the tools for oral and dental care are exposed to contamination by external action practically unprotected. In terms of construction, this case does not meet the requirements for functionality combined with a pleasing appearance either.

It is an object of the present invention to improve upon known cases for receiving oral and dental care tools as follows:

The tools are to be protected from contamination by external action to the largest possible extent whilst they should be readily identifiable and accessible when withdrawn from the case. The case is to be of an enclosed and appealing construction and the insert is to be easy to clean.

Because the element is configured as a substantially plane case lid covering the interior space in the dust-guard position, and because the element and the insert are in connection with each other by means of at least one lever mechanism which converts the pivotal motion of the element into a lifting motion of the insert, the tools stored in the insert are very well protected from contamination in the dust-guard position of the element. In the open position of the element, the insert is partly extended out of the interior space of the case by means of the lever mechanism, thus providing a good view of, and ready access to, the tools partially protruding from the insert. The case is of an enclosed and appealing construction, its function being self-explanatory. Because the lever mechanism is comprised of a lever arm which is arranged on the element and is connected with a lever provided on the insert guided in the case in a straight-line motion, simple constructional means are provided for implementation of the lever mechanism. When the element is opened or closed, the lever arm arranged on the element performs a pivoting motion which, through a connection with a lever on the insert guided in a straight-line motion, is converted into a lifting motion of the insert. Because the lever arm is arranged above the pivot axis in the area of that half of the case lid that is proximate the pivot axis, the tools are readily accessible in the insert when the element is in the open position. Configuring the lever arm as a fixed wall member whose end remote from the element has a cylindrical pin passing therethrough imparts the necessary stability to the lever arm while making it possible for the injection-molded case lid to be manufactured by means of simple injection molds. Advantageously, a support wall is provided at the top end of the insert in a mid-area between the compartments, the wall having over a partial area thereof two opposite cutouts shaped in the manner of an elongated hole. By these means, a simple connection between the element and the insert is afforded. Providing the insert with four compartments forming two pairs, with the two compartments of each pair being immediately juxtaposed with a center wall therebetween while the two pairs are separated by a gap, affords the advantage of an enclosed and aesthetically appealing construction of the insert while at the same time providing the lever arm with the necessary freedom of motion. Because the support wall rests on the pin in frictional engagement therewith, a very simple connection is accomplished between the element and the insert. The upward movement occurring as the element is opened is effected by the lever arm arranged on the element and engaging under the support wall, while the insert performs the downward movement as a result of the influence of gravity preferably without the use of positive engagement means. Configuring the insert such as to be open at the edge and bottom below the support wall affords easy withdrawal from the case, such as for cleaning purposes. Apertures provided in the insert in a bottom area of the compartments support the drying process of the oral and dental care tools for the purpose of maintaining sanitary storage conditions, because the liquid clinging to these tools following use is allowed to be drained from the respective compartment. By providing the case with an opening in the area of a case wall proximate the bottom, with an inclined plane which has its inclination directed towards the opening being arranged below the insert and extending inside the interior space over the height of the opening, the water dripping from the compartments is drained from the case, thereby preventing any impairment of the functions of any additional, especially electrical, elements that may be held in the case. Furthermore, a case constructed in this manner is extremely easy to clean. Finally, in combination with the provision of at least one narrow slit between the element when in the dust-guard position and the side walls of the case, an optimum air circulation is thereby ensured by the opening in the case wall, the apertures in the bottom area of the compartments and the slit between the element and the side walls of the case, which facilitates the drying process of the tools in the compartments considerably.

Further advantages of the invention will become apparent from the subsequent description of the sole embodiment illustrated in the accompanying Figures.

Figure 1:
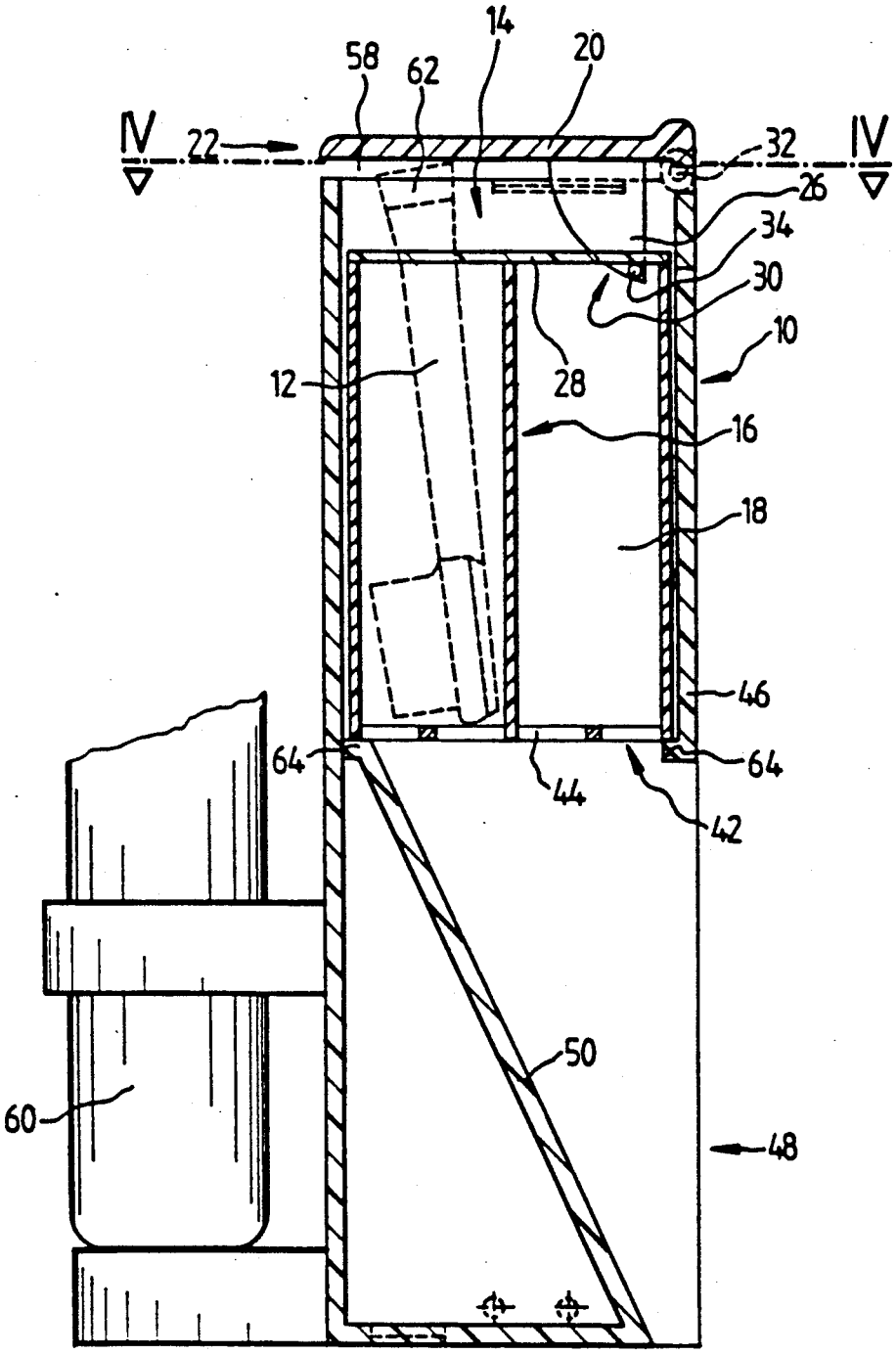
FIG. 1 is a longitudinal sectional view of the case, taken along the line II—II of FIG. 4 and showing the element in the dust-guard position.

In the Figures, reference numeral 10 identifies a case having an interior space 14 in which an insert 16 is arranged. The insert 16 incorporates several compartments 18 for holding oral and dental care tools, in the present example, for holding a brush head 12 for an electric toothbrush 60 of which only a fragment is shown. It will be understood that the compartments 18 may also accommodate jet heads for electrically operated oral jet devices or other accessories necessary for oral or dental care.

Figure 2:
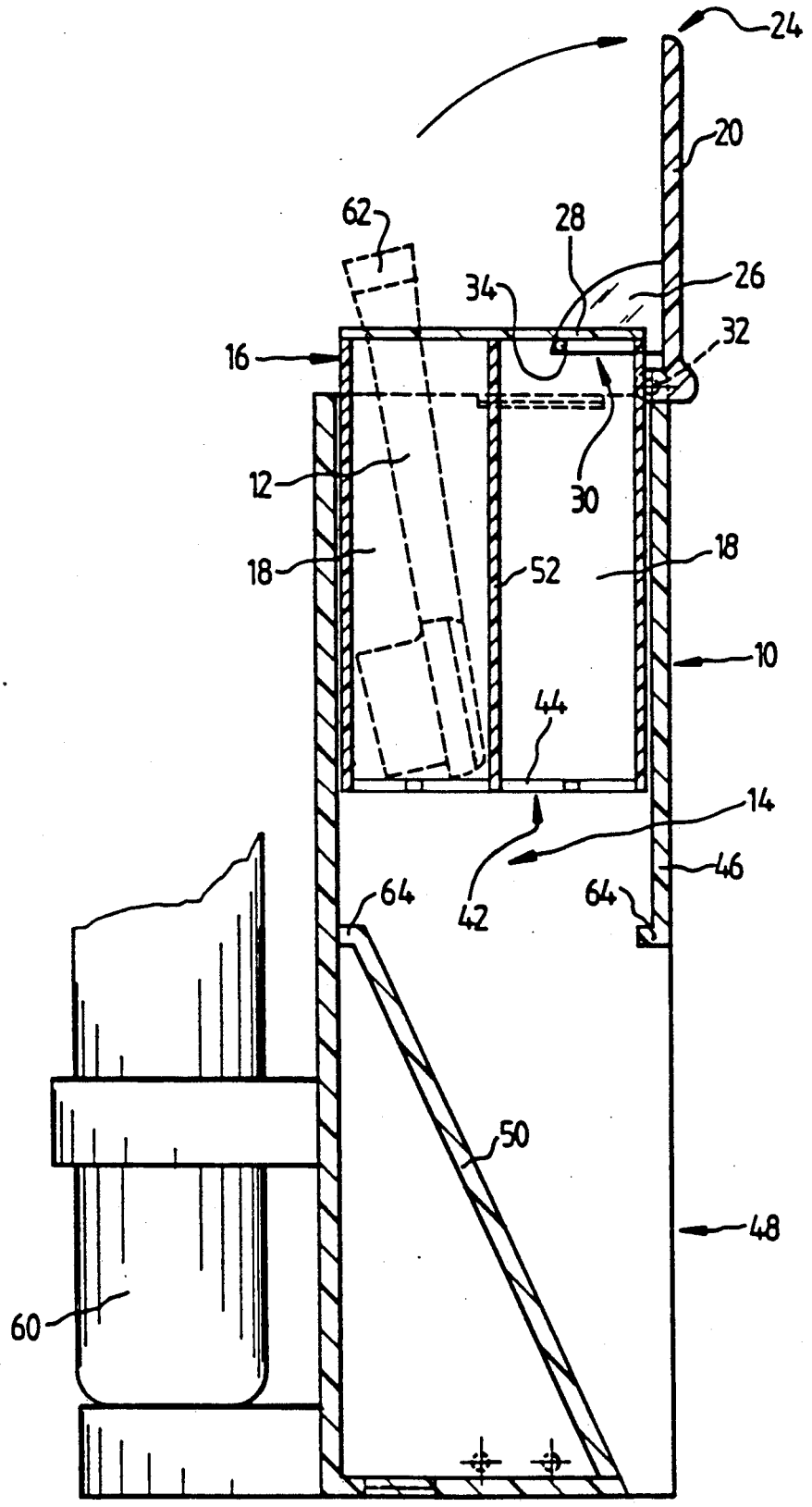
FIG. 2 is a longitudinal sectional view of the case, taken along the line II—II of FIG. 4 and showing the element in the open position.
Figure 3:
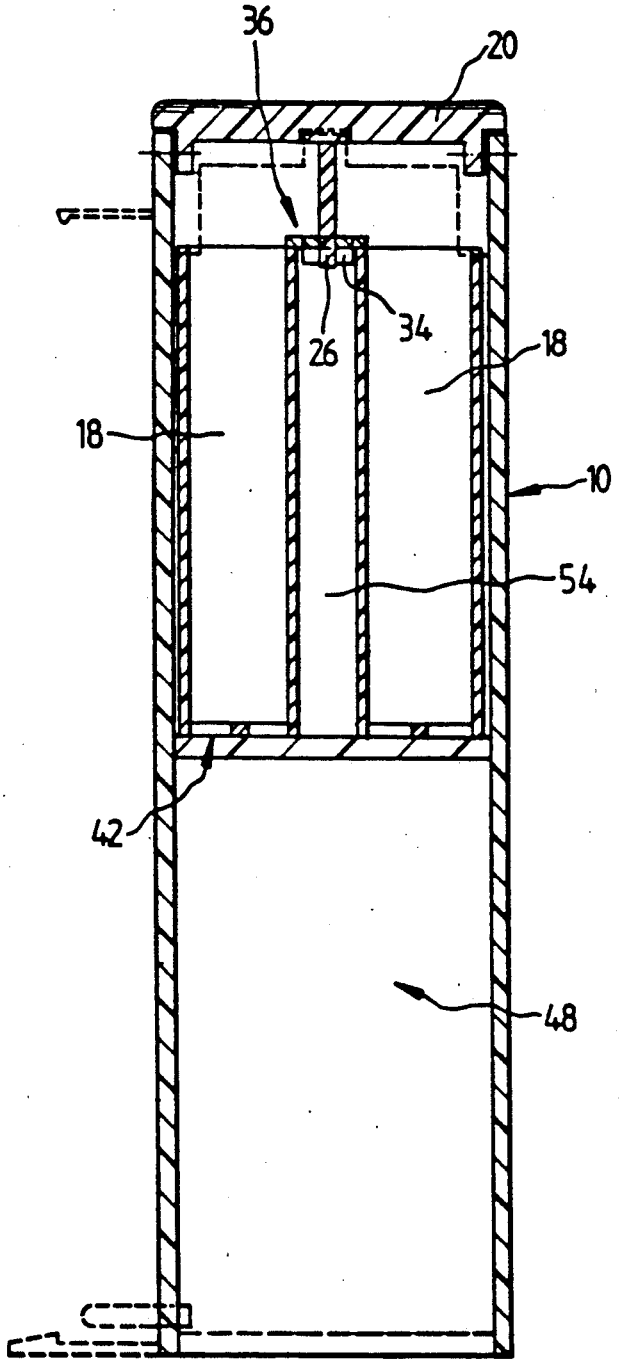
FIG. 3 is a longitudinal sectional view of the case, taken along the line III—III of FIG. 4 and showing the element in the dust-guard position.
Figure 4:
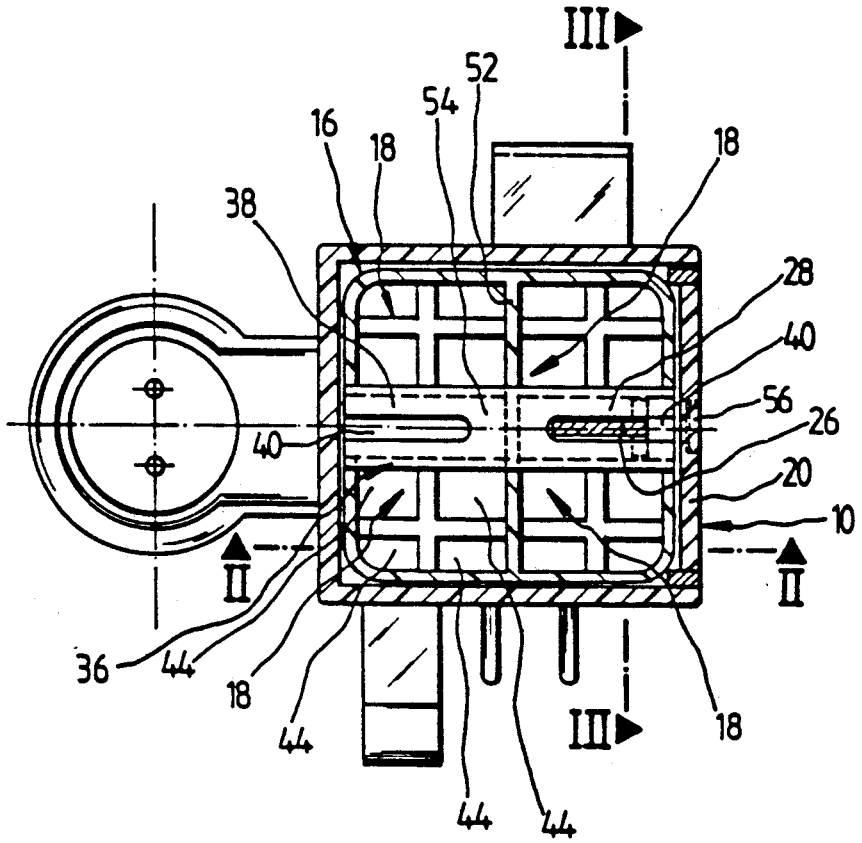
FIG. 4 is a cross-sectional view of the case, taken along the line IV—IV of FIG. 1.

The tools are conventionally provided with a colored ring 62 to make it easier to distinguish between several, otherwise for example identical, interchangeable toothbrush heads so that unintentional confusion is prevented from occurring. The case 10 which has its top end open is provided with an element 20 which in the present embodiment is configured as a substantially plane case lid. This element 20 is pivotal about a pivot axis 32 from a dust-guard position 22 (FIG. 1) to an open position 24 (FIG. 2.). In an area above the pivot axis 32, a lever arm member 26 is provided on the element 20. This lever arm member 26 includes a wall portion that extends vertically from element 20 and includes at its end remote from element 20 cylindrical pin portion 34 whose longitudinal axis extends parallel to the pivot axis 32. The wall portion of the lever arm member 26 extends through cutout 40 shaped in the manner of an elongated hole in support wall 38 which is provided at the top end of insert 16 between the compartments 18. The bottom side 28 of support wall 38 rests on pin 34. The slotted area of the support wall 38 forms a cam surface 28 which is in frictional engagement with pin portion 34 of the lever arm 26, so that the lever arm 26 and the cam surface 28 combine to provide a lever mechanism 30. In certain applications it is advantageous to provide two lever mechanisms 30 which are arranged in the two side areas of element 20 and insert 16. The use of two lever mechanisms 30 proves useful particularly for an insert which is rectangular rather than square in cross section, in which tools are received in serially arranged compartments 18.

When the element 20 is pivoted about the pivot axis 32 from the dust-guard position 22 to the open position 24, the pin 34 describes a circular arc. This circular-arc path of the pin 34 is converted into a linear motion, particularly a vertical lifting motion of the insert 16 guided in the case 10 in a straight-line motion, with the pin 34 sliding horizontally along the underside 28 of the support wall 38. In the open position 24, the insert 16 protrudes from the interior 14 of the case 10 by a certain amount. As the compartments 18 of the insert 16 having a depth lesser than the length of the tools held therein, the user is in a position to readily identify the colored rings 62 and remove the tools after opening of the element 20. In the dust-guard position 22 of the element 20, the entire case 10 forms an enclosed unit of a pleasing external appearance, while the tools stored in the compartments 18 are perfectly protected from external contamination. Locking means 56 enable the element 20 to be located or secured in the open position 24, when necessary.

The support wall arranged in a mid-area 36 between the compartments 18 in applications where only a single lever mechanism 30 is used includes two opposite cutouts 40 extending over a partial area in the manner of an elongated hole. In fact, only one of the cutouts is in connection with the lever arm 26, the second cutout 40 coming to bear when the insert 16 is replaced into the case 10 after its removal, being turned about its longitudinal axis through 180°.

For easy removal of the insert 16, such as for cleaning, the insert 16 has its edge and bottom open below the support wall 38. In particular, the insert 16 has four compartments 18 forming two pairs, with the two compartments of each pair being immediately juxtaposed with a center wall 52 therebetween while the two pairs are separated by a gap 54. When the insert 16 is placed in the interior space 14 of the case, the lever arm 26 including the pin 34 are passed through the entire length of the gap 54 until the sectorial wall of the lever arm 26 extends through the cutout 40 and the support wall 38 comes to rest on the pin 34.

When the element 20 is closed, the pin 34 executes a return motion on its orbit, and insert 16 follows as a result of the influence of gravity. Of course, it will be apparent that a downward motion accomplished by positive guiding means is equally possible. In the dust-guard position 22 of the element 20, the insert 16 is held either by the pin 34 or by abutment means 64 arranged on the inner walls of the case 10.

In the bottom areas 42 of the compartments 18 of the insert 16 apertures 44 are provided allowing liquid to drain or drip from the tools after use. In a case wall 46, preferably in a rear wall of the case, an opening 48 is provided in a bottom portion thereof, with a wall being arranged as an inclined plane 50 extending below the insert 16 in the interior space 14 of the case 10 over at least the height of the opening 48. The liquid dripping down from the insert 16 hits the inclined plane 50 which is inclined in the direction of the opening 48, being discharged from the case 10 by flowing down the inclined plane 50. This major opening 48 permits easy cleaning of the inclined plane 50, if at all necessary.

In the dust-guard position 22, the element 20 is not hermetically sealed with the upper edge of the case 10, so that narrow slits 58 remain between the bottom edge of the element 20 and the upper edge of the case, their width being variable, if necessary, by recesses in the side walls of the case. In combination with the opening 48 and the apertures 44, these slits 58 ensure sufficient circulation of air favoring the drying process of the tools stored in the insert. As a result of the small width of the slits 58, contamination of the tools by external influence is not promoted.

It will be appreciated that the invention is not limited to the embodiment described and that it is capable of other embodiments of, for example, one or several lever mechanisms or the insert. Thus, for instance, the lever arm or the lever arms 26 may be rod-shaped and pivotally mounted on the element 20. When the element 20 is moved to the open position 24, the lever arm or arms move into abutment with the underside of the element 20. Also, rack-and-pinion mechanisms or the like may be provided without departing from the scope of the invention. Of course, it will be obvious that various modifications may be made also to the insert 16 and be adapted to the mechanism used for the respective application.

What is claimed is:

1. A case for tools of the oral and dental type comprising chamber defining structure with an opening at the top of said chamber and container support structure in said chamber spaced from said top opening, lid structure coupled to said chamber defining structure and movable between a dust-guard position substantially closing said top opening and an open position in which said top of said chamber is open, a tool receiving container removably disposed in said chamber, said container including seat structure and coupling structure, said container having a first position in which the top of said container is below said top opening of said chamber defining structure and aid seat structure is seated on said container support structure, and manually releasable linkage structure coupled between said lid structure and said coupling structure, said linkage structure being moveable in response to movement of said lid structure from said dust-guard position to said open position to raise said container from said first position to a second position in which the top of said container is above the top of said chamber, said linkage structure being adapted to be released from said coupling structure during manual further raising of said container from said second position to a third position in which the base of said container is lifted above the top of said chamber defining structure so that said container is completely detached and removed from said chamber defining structure.

2. The case as claimed in claim 1, wherein said linkage structure includes lever structure fixed on said lid structure and said coupling structure includes cam surface structure on said container for cooperating engagement with said lever structure.

3. The case of claim 2 wherein said lid structure is movable about a pivot axis fixed to said chamber defining structure, and said lever structure is in the are of that half of said lid structure that is proximate said pivot axis.

4. The case of claim 2 wherein said lever structure is configured as a wall portion whose end remote from said lid structure has a cylindrical cam pin portion for cooperating engagement with said cam surface structure.

5. The case of claim 1 wherein said container includes a support wall adjacent its top end, said support wall having a cutout shaped in the manner of an elongated hole that defines said coupling structure.

6. The case of claim 5 wherein said linkage structure includes a pin portion fixed to said lid structure, and said support wall rests on said pin portion in frictional engagement therewith.

7. The case of claim 5 wherein said container includes drainage opening structure below said support wall.

8. The case of claim 1 wherein a bottom portion of said container has drain aperture structure therein.

9. The case of claim 1 wherein said container is provided with four compartments forming two pairs, with the two compartments of each pair being immediately juxtaposed with a center wall therebetween, and said two pairs of compartments are separated by a gap.

10. The case of claim 1 wherein said chamber defining structure is provided with opening structure proximate its bottom, and inclined plane structure which has its inclination directed towards said opening is arranged below said container and extends inside the interior space of said chamber over at least the height of said opening.

11. The case of claim 1 wherein at least one narrow slit is provided between said lid structure when in the dust-guard position and the side walls of said chamber defining structure.

12. The case of claim 11 wherein a bottom portion of said compartment has drain aperture structure therein, and said chamber defining structure is provided with opening structure proximate its bottom, and inclined plane structure arranged below said container and directed towards said opening and extending inside the interior space of said chamber over at least the height of said opening.

13. The case of claim 1 wherein said container includes a support wall adjacent its top end, said support wall having elongated cam surface structure that defines said coupling structure, and said linkage structure includes a member fixed to said lid structure whose end remote from said lid structure has a cam portion for cooperating engagement with said cam surface structure.

14. The case of claim 13 wherein said lid structure is movable about a pivot axis fixed to said chamber defining structure, and said member is arranged in the area of that half of said lid structure that is proximate said pivot axis and extends perpendicularly to said pivot axis.

15. The case of claim 14 wherein said container is provided with four compartments forming two pairs, with the two compartments of each pair being immediately juxtaposed with a center wall therebetween, and said two pairs of compartments are separated by a gap, a bottom portion of said compartment has drain aperture structure therein, and said chamber defining structure is provided with opening structure proximate its bottom, and inclined plane structure arranged below said container and directed towards said opening and extending inside the interior space of said chamber over at least the height of said opening.

16. The case of claim 15 wherein at least one narrow slit is provided between said lid structure when in the dust-guard position and the side walls of said chamber defining structure.

* * * * *